United States Patent [19]

Franco et al.

[11] Patent Number: 4,881,599

[45] Date of Patent: Nov. 21, 1989

[54] MECHANICAL SYSTEM FOR DIVERSION IN THE ACIDIZING TREATMENT OF OIL FORMATIONS

[75] Inventors: Zadson d. A. Franco; Demóstenis A. W. Barreto, both of Aracaju, Brazil

[73] Assignee: Petroleo Brasileiro S.A. - Petrobras, Rio de Janeiro, Brazil

[21] Appl. No.: 174,557

[22] Filed: Mar. 29, 1988

[51] Int. Cl.[4] ..... E21B 33/124; E21B 33/13

[52] U.S. Cl. ..... 166/284; 166/193

[58] Field of Search ..... 166/284, 281, 192, 193, 166/202

[56] References Cited

U.S. PATENT DOCUMENTS

| | | | |
|---|---|---|---|
| 2,642,142 | 6/1953 | Clark | 166/281 |
| 3,010,514 | 11/1961 | Fox | 166/284 |
| 3,011,548 | 12/1961 | Holt | 166/284 |
| 3,174,546 | 3/1965 | Flickinger | 166/284 |
| 3,895,678 | 7/1965 | Wright et al. | 166/284 |
| 4,102,401 | 7/1978 | Erbstoesser | 166/284 |
| 4,139,060 | 2/1979 | Muecke et al. | 166/281 |
| 4,160,482 | 7/1979 | Erbstoesser et al. | 166/284 |
| 4,187,909 | 2/1980 | Erbstoesser | 166/284 |
| 4,194,561 | 3/1980 | Stockley et al. . | |
| 4,195,690 | 4/1980 | Erbstoesser et al. | 166/281 |
| 4,244,425 | 1/1981 | Erbstoesser | 166/284 |
| 4,279,303 | 7/1981 | Erbstoesser | 166/284 |
| 4,407,368 | 10/1983 | Erbstoesser | 166/284 |
| 4,421,167 | 12/1983 | Erbstoesser et al. | 166/255 |
| 4,488,599 | 12/1984 | Graham et al. | 166/255 |
| 4,505,334 | 3/1985 | Doner et al. | 166/284 |

*Primary Examiner*—Jerome W. Massie, IV
*Assistant Examiner*—Terry Lee Melius
*Attorney, Agent, or Firm*—Sughrue, Mion, Zinn, Macpeak & Seas

[57] ABSTRACT

The invention concerns a mechanical system which permits the use of ball sealers as diversion agents in the acidizing of productive hydrocarbon formations, by associating the advantages of mechanical diversion to the advantages of the use of ball sealers, whatever their density.

The mechanical system comprises a packer (7), a swivel (18), a centralized tail (9), a ball ejection port (10) and two cups (11).

The mechanical system operation involves the adequate positioning of each of its components in such a manner as to permit the ball sealers to attain sufficient velocities to be driven mechanically to their targets.

14 Claims, 2 Drawing Sheets

MECHANICAL SYSTEM FOR DIVERSION IN THE ACIDIZING TREATMENT OF OIL FORMATIONS

FIELD OF THE INVENTION

This invention concerns a mechanical system which permits the use of ball sealers as diverting agents in the acidizing of productive oil-bearing formations.

BACKGROUND OF THE INVENTION

It is common knowledge that fluids such as oil and natural gas are produced from permeable, porous, subsurface formations. The porosity of a formation is a measure of its ability to store oil and/or gas, whereas its permeability is an indication of the conductivity of the fluids contained in such formation.

Generally, the procedure involved in making an oil or gas well is to drill a hole from the surface down to the desired production zone and then provide the hole with casing. The casing-in of a hole consists in running a casing string down to a point close to its bottom and then pumping cement under pressure down the casing string and up the annular space between the casing and the wall of the bore hole.

The cement is subsequently allowed to set for a considerable length of time, in order to optimize its capability of forming a bond impermeable to water and oil between the casing and the bore wall. Once the cement has hardened, a special tool is run downhole and positioned at the reservoir depth, where it is caused to fire bullets which will perforate the casing, the cement sheath and even the rock, in the reservoir depth, in order to permit the flow of oil and gas through the production zone and the casing perforations and into the casing string.

During the production period of a well, it is often necessary to boost its hydrocarbon output or stimulate its production. Many reservoirs which require stimulation treatment do not show homogeneous permeability, that is, they either consist of layers of variable permeabilities or contain fractures which cause a treatment fluid to advance in the formation in a non-uniform manner. For instance, a highly permeable region in the formation will consume most of the stimulation treatment, leaving a less permeable region deprived of such treatment.

To overcome this problem, it is necessary to arrange a means of diverting the treatment fluid from the most permeable into less permeable zones of the formation.

Acidizing is an oilwell stimulation technique which permits an increase in the production output of a well and one feature which contributed towards the success of acidizing was the development of means of diversion.

Consequently, various techniques and diversion agents have from time to time been suggested with the aim of forcing the treatment fluid to reach the formation region that is to be treated. These have included diversion agents or chemical divergents, diversion with foam, mechanical diversion, and diversion with ball sealers.

The action of the diversion agents or chemical divergents is to form bridges over the formation pores, thereby causing a preferred reduction or elimination of the flow into those areas which have the highest receptivity and forcing the fluid into permeable regions, so that the treatment will become more uniform.

In gun-perforated wells, this bridging may be formed over the perforations, inside the perforations, or over the rock surface after the tunnels in the cement sheath. The resulting kind of plugging and the method of choice will depend on downhole conditions, type of formation, etc.

In diversion with chemical additives, the additives may be carried by the treatment fluid itself, or they may be conveyed in cushions, using a viscous fluid for transportation of the material. Usually these include sifted salt, solid organic acids, inert organic resins, oil-soluble waxes, and various combinations of these products.

This technique, however, has the following disadvantages: some good diverters tend to deteriorate beyond a certain high temperature: impurities contained in the product may become a source of damage to the formation; it may be difficult to choose the ideal divergent for a specific problem, and this may even include unavailability of the product.

As already mentioned, there are, other than this diversion technique, the techniques of diversion with foam, mechanical diversion and diversion with ball sealers.

Foam has long been known as a fluid capable of promoting diversion, but having the peculiarity of developing substantial loss of head while flowing through pipes and porous media. Depending on factors such as quality of the foam and pumping rate, high viscosities may develop as a result of the resistance to penetration into the porous medium. Accordingly, the introduction of a foam cushion between stages of an acidizing treatment ought to promote a diversion of the treatment.

This technique, however, has the drawback of requiring a source of gas supply and foam-making equipment; also, there is a high cost involved in the installation and handling of such equipment.

Mechanical diversion is the most positive method of diversion, since each stage of the treatment will act only on a secluded zone. Depending on the interval to be treated, it is not always possible to use mechanical diversion efficiently; this would be the case where the treatment is applied to intervals with a large area of perforations or intervals with large unperforated areas. In the former case, mechanical diversion would not be possible due to the widespread area involved, whereas in the latter case the moving of the equipment used for packing can cause substantial wear and consequent leaks, sometimes as serious as to require replacement. Besides, during trips the tool will leave the treated interval exposed to the completion fluid which may, in contact with the treatment fluids, jeopardize the acidizing achievements.

Regarding the conventional ball sealers, they are used in specific fracturing methods, since they are effective only at relatively high flow rates, which are normally not used in acidizing.

With the event of the availability of buoyant sealers, i.e. ball sealers which have a density lower than that of the treatment fluid, it became possible to widen the scope of their applicability due to the possibility of conveying them even at low flow rates.

However, such flow rates are not sufficient to carry the balls all the way to their target, i.e. into the perforations in the gunned intervals and, besides, this offers no selectivity in the treatment of distinct zones. Though certain flow rates may be capable of carrying the balls all the way downhole in the stream inside the tubing, they will upon reaching the casing cease to be sufficient to continue to convey them to their targets in the gunned intervals to be treated.

Regarding the state of the art developed in this field and related patents, we can mention, for instance, publications U.S. Pat. Nos. 4102401, 4139060, 4160482, 4195690, 4244425, 4279303, 4407368, 4421167, 4488599, and U.S. Pat. No. 4505334 4102401, 4244425, 4279303, 4407368 and U.S. Pat. No. 4505334 suggest various types of ball sealings as diversion agents; U.S. Part. No. 4160482 improves on the performance of buoyant ball sealers by controlling the speed of the treatment fluid; U.S. Pat. No. 4139060 and U.S. Pat. No. 4195690 suggest the use of two fluids of densities different from that of the ball sealers; and US 4421167 and US 4488599 are aimed at controlling the displacement of the balls by limiting their density according to the density of the treatment fluids.

Also regarding the prior art developed in this field, it was found that difficulties were met in controlling the correct setting of the balls in the interval to be treated; this could mean balls failing to reach their target or, in many cases, the occurrence of stimulation at intervals where stimulation would not be desired.

As a consequence, certain methods and devices have already been developed for the purpose of positioning the ball sealers selectively at adequate places so as to permit efficient diversion.

U.S. Pat. No. 4187909, for instance, attempts to solve this problem with an apparatus which carries the ball sealers inside it and which is run downhole to a position between two intervals to be treated. This apparatus has a means of permitting the flow of the balls only in the direction of the lower interval, thereby plugging it and leaving the upper interval free.

U.S. Pat. No. 4194561 describes an apparatus devised for proper conveyance of the ball sealers, to be positioned above the interval to be treated. It is provided with means which prevent the balls from flowing into upper intervals where plugging is not desired.

FIGS. 4 and 5 show a diversion operation using ball sealers according to the prior art, with FIG. 4 showing the use of heavy balls and FIG. 5 showing the operation with buoyant balls. In these Figures, as in all publications on patents and prior art, it can be observed that the treatment fluid together with the ball sealers develops certain flow rates in the stream down the production string (1) which slow down drastically and suddenly upon reaching the casing region (2). This is caused by the large increase in flow area and its consequence is a path which lacks efficiency in accomplishing the intended objective, i.e. in reaching the interval to be treated (5). The ball sealers, instead of flowing all the way to the intended interval (5), tend to locate themselves just above the bottom packer (4) if heavy, or in the region (6) just below the upper packer (7) if buoyant.

SUMMARY OF THE INVENTION

All the cited problems of the prior art have been solved with the present invention by means of a mechanical system which permits stimulation of the production in an oil well in a quite simple and efficient manner, by assuring the flow rate in the casing which will be sufficient to convey the ball sealers to their target regardless of whether heavy or byoyant balls are used.

Accordingly, an objective of the present invention is a mechanical system for the treatment of intervals in the same well which associates both the advantages of mechanical diversion and the advantages of the use of ball sealers.

Another objective of this invention is a mechanical system which, in a simplified manner, accomplishes the said treatment with a minimum of trips and an optimization of the performance of the ball sealers.

Also an objective of this invention is a mechanical system which permits the use of ball sealers as the diversion agent in an acidizing operation regardless of their density, with a substantial reduction in the length of the operation as compared to other mechanical systems.

Yet another objective of this invention is a mechanical system that permits an increase in the velocity of the treatment fluid in which the ball sealers are conveyed, the indiscriminate use of ball sealers, whether light or heavy, and a change in the geometry of the flow which forces the balls towards their target, i.e. towards the perforations in the gunned intervals.

DETAILED DESCRIPTION OF THE INVENTION

The mechanical system contemplated in this invention comprises an assembly formed by a packer, a swivel, a tubing tail with centralizer, a ball ejection port and two circulating-washer cups.

Figure 1:
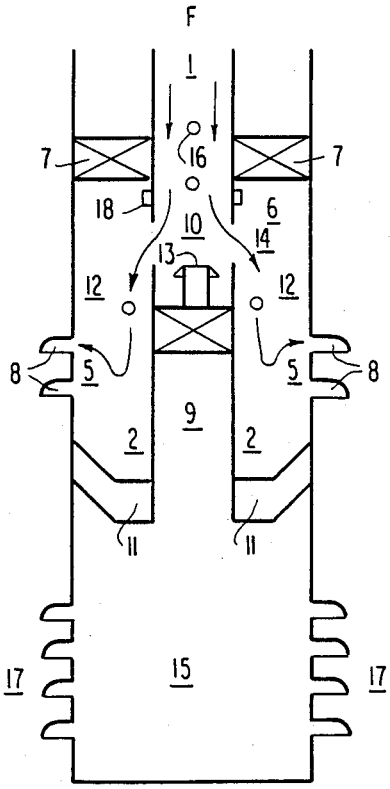
FIG. 1 shows a sectional view of a production string according to an embodiment of the invention.
Figure 2:
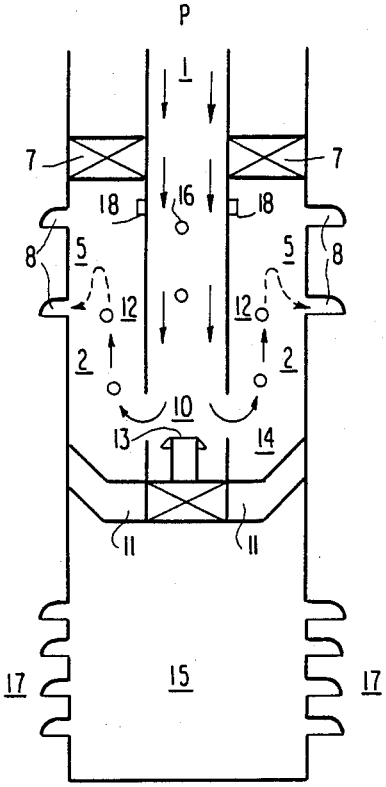
FIG. 2 shows a sectional view of a production according to another embodiment of the invention.

The drawings in FIGS. 1 and 2, which accompany the specification, show an oil well (15) which is in contact with the formation (17) through the perforations in the gunned intervals (8). Inside this well, the drawings show the production string (1), the packer (7), the swivel (18), the centralized tail (9), the ball ejection port (10) and the circulating washer cups (11).

Figure 3:
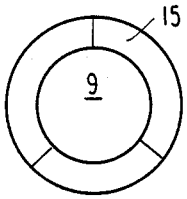
FIG. 3 shows a sectional view of a centralized tail according to the invention.
Figure 4:
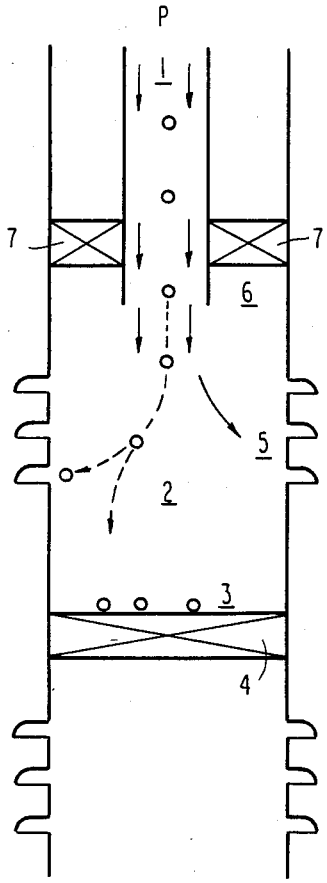
FIG. 4 PRIOR ART
FIGS. 4 and 5 are sectional views of conventional production strings.
Figure 5:
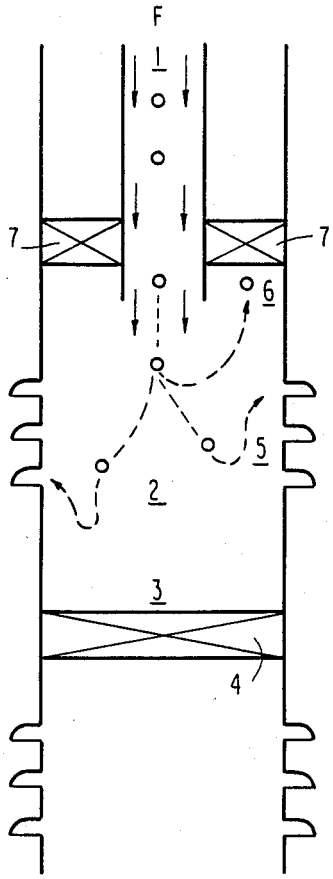
FIG. 5 PRIOR ART

The packer (7) could be a weight-set mechanical packer or a traction packer. The latter may have its sealing ability impaired by the forces developed at the cups (11), which act in in a direction opposite to its unsetting, but the possibility of its use in shallow wells is an option not to be dismissed. The preferred packer, however, is the weight-set packer As shown in FIG. 3, the centralized tail (9) consists of tubing provided with ear-type centralizers (20). For perfect centralization using a smaller number of centralizers, the centralized tail may consist of tubing with three centralizers spaced 2.5 m from one another, and a 120° C. phase shifter. For very long tails, centralized tubes may be alternated with uncentralized tubes, in which case the tubing just below the packer and just above the cups will not require this centralization. However, centralization is of vital importance in order that the ball sealers may have access to all the perforations in the gunned interval, otherwise, with the tail leaning against the casing wall, this will not occur.

The ball ejection port (10) is a tubular piece with two reactangular apertures at the sides (14) in which a fishable ball seat (13) is adapted.

Two circulating-washer cups (11) are adapted either at the ball ejection port (10) or at the centralized tail (9), depending on the type of ball sealers used.

To operate the mechanical system of the present invention for the treatment of selected intervals, two embodiments are contemplated, according to whether the ball sealers used are heavy (FIG. 2) or buoyant (FIG. 1). Heavy balls are those whose density is higher than that of the treatment fluids and buoyant balls are those having less density than the fluids.

In one preferred embodiment, the mechanical system operates with heavy ball sealers (FIG. 2) and is characterized by:

positioning the weight-set packer (7) and the swivel (18) above the centralized tail (9) and the ball ejection port (10), which accordingly will be located at the lower end of the tail (9) and this whole arrangement will be above the cups (11) which will be located below the interval to be treated (2);

ejection of the heavy ball sealers (16) in volumes so predetermined as to obtain an upward flow in the annular space (12) between the centralized tail (9) and the casing of the well and drive the balls mechanically into the region closest to their locus of action, i.e. into the perforations (8) in the gunned intervals.

In the other preferred embodiment, using buoyant balls, the mechanical system is characterized by:

positioning the weight-set packer (7) and the swivel (18) above the ball ejection port (10) and the centralized tail (9), which accordingly will be located at the lower end of the port (19) and this whole arrangement will be above the cups (11) which will be located below the interval to be treated (2);

ejection of buoyant balls (16) in volumes so predetermined as to obtain a downward flow in the annular space (12) between the centralized tail and the casing of the well and drive the balls mechanically into the region closest to their locus of action, i.e. into the perforations (8) in the gunned intervals.

The number of buoyant or heavy ball sealers is determined by the number of perforations existing in the casing.

With the geometry of the mechanical system of this invention, it was possible to drive the balls mechanically to their target by means of the annular flow (12) at a velocity sufficient to cause the balls to reach the interval to be treated, the velocities thus obtainable being higher than those obtainable with the processes of the prior art.

This better effect was achieved for both of either heavy or buoyant ball sealers. Accordingly, any ball can be useful in reaching the objectives of this invention.

In accordance with the foregoing, we can stress the following advantages of the invention:

it isolates the target interval from other intervals existing in the well, in a simple and efficient manner;

it permits individual treatment of different intervals by simple repositioning of the mechanical system;

it creates wider possibilities for the scope of application of heavy ball sealers by giving them a better performance than can be obtained with buoyant ball sealers used in the conventional manner of other techniques of the prior art;

it optimizes the performance of buoyant ball sealers and permits their use in operations conducted at flow rates which otherwise would not be capable of developing sufficient velocities in the casing to drive the balls all the way to the target perforations;

the ball sealers, regardless of whichever are used, whether heavy or buoyant, are conveyed mechanically into the region closest to their point of action, i.e. to the gunned perforations;

in operations using only one type of treatment fluid, the ball sealings may be distributed along the treatment;

no damage is caused to treated intervals.

An example of the invention is given below only for the purpose of illustration - not to be construed as a form of restricting—its embodiment.

EXAMPLE 1

In the conditions defined below:

(a) oil production well; casing size: 14 cm (5½")

size of the oil string: 6cm (23/8 ")

packer positioned at: 731 m ball ejection port positioned at: 749 m (the interval to be treated being located from 738 m to 746m)

capacity of the oil string: 0.02077 lt/cm (0.00387 bbl/ft)

capacity of the annulus between the casing and the oil string: 0.0982 lt/cm (0.0183 bbl/ft)

(b) treatment fluid (HCl 15%)

volume: 9842 lt (2600 gal)

specific gravity: 1.066 kg/lt (8.962 lgs/gal)

flow rate in the oil string: 157.3 m/min (516 ft/min)

flow rate in the annulus: 33.2 m/min (109 ft/min)

(c) ball sealings specific gravity: 1.092 kg/lt (9.174 lbs/gal)

diameter: 2.22 cm /0.875")

slip velocity inside the fluid: 7.5 m/min (24.6 ft/min) the following results were obtained (a) treatment fluid time to travel down the oil string: 749/157.3=4.76 min time to travel up the annulus: 749−738/33.2=0.33 min time to reach the target: 4.76+0.33=5 min (b) ball sealings velocity down the oil string: 157.3+7.5=164.6 m/min velocity up the annulus: 33.2−7.5=25.7 m/min;

time to travel down the oil string: 749/164.6=4.55 min;

time to travel up the annulus: 749−738/25.7=0.42 min;

time to reach the target: 4.55+0.42=5 minutes;

time to reach the target: 4.55+0.42=5 minutes; for which the ejection of 1 ball for each 17.5 lt of fluid was an adequate distribution. To ensure that all holes will be sealed, it is recommended that 5 to 10% excess balls should be put in, evenly distributed between the first and the latest programmed balls.

EXAMPLE 2

In the same well described in the preceding example, the ball ejection port was positioned at the upper part of the centralized tail, just below the swivel. We used the same treatment fluid but the ball sealers had the following characteristics:

specific gravity: 0.9 g/cm$^3$ (7.506 lbs/gal);

diameter: 2.22 cm (0.875");

upward slip velocity inside the fluid; 7.4 m/min (24.3 ft/min);

and obtained the following results:

(a) treatment fluid time taken to travel down the oil string: 731/157.3=4.65 min;

time taken to travel down the annulus: 746−731/33.2=0.45 min;

time taken to reach the target: 4.65+0.45=5.1 min.

(b) ball sealers velocity down the annulus: 33.2+7.4=40.6 m/min;

time to travel down the oil string: 731/149.9=4.87 min;

time to travel down the annulus: 746−731/40.6=0.36 min;

time to reach the target: 4.87+0.36=5.2 minutes.

Thus, the same distribution used for the ejection of balls proved efficient for the desired sealing.

We claim:

1. An apparatus for supplying treatment fluid to at least one perforation contained in an oil well casing comprising:

a production string;

a packer, disposed above the at least one perforation to be treated, for fixing said production string and for providing a hydraulic seal between said production string and the oil well casing;

washer cups, disposed below the at least one perforation to be treated, for providing a hydraulic seal between said production string and the oil well casing; and a swivel disposed directly below said packer for turning said production string;

wherein said production string includes a centralized tail portion disposed between said packer and said washer cups, said centralized tail portion having a ball ejection port for introducing the treatment fluid from said producing string into an interval formed between said packer and said washer cups containing the at least one perforation.

2. The apparatus according to claim 1, wherein said packer is a mechanical packer.

3. The apparatus according to claim 2, wherein said packer is a weight-set packer.

4. The apparatus according to claim 1, wherein said centralized tail portion of said production string includes ear-type centralizers.

5. The apparatus according to claim 1, wherein said ball ejection port comprises a tubular piece with rectangular openings.

6. The apparatus according to claim 5, further comprising a fishable ball seat provided in said production string directly below said ejection port.

7. The apparatus according to claim 1, wherein the treatment fluid contains one of heavy ball sealers and buoyant ball sealers.

8. The apparatus according to claim 1, wherein the treatment fluid contains heavy ball sealers, and wherein said ejection port is disposed at a lower end of said centralized tail portion and below the at least one perforation to be treated so that the treatment fluid containing the heavy ball sealers which is ejected from said ejection port obtains an upward flow into the interval.

9. The apparatus according to claim 1, wherein the treatment fluid contains buoyant ball sealers and wherein said ejection port is disposed at an upper end of said centralized tail portion and above the at least one perforation to be treated so that the treatment fluid containing the buoyant ball sealers which is ejected from said ejection port obtains a downward flow into the interval.

10. The apparatus according to claim 8, wherein the number of heavy ball sealers contained in the treatment fluid is predetermined in accordance with the number of perforations contained in the oil well casing.

11. The apparatus according to claim 9, wherein the number of buoyant ball sealers contained in the treatment fluid is predetermined in accordance with the number of perforations contained in the oil well casing.

12. A method of introducing treatment fluid containing heavy ball sealers from a ball ejection port of a production string into an oil well having a casing, the production string having means attached thereto for isolating an interval of the oil well, the casing having at least one perforation, the method comprising the steps of:

positioning the production string into the oil well so that the at least one perforation is contained within the isolated interval of the oil well and so that the ejection port is disposed below the at least one perforation;

introducing the treatment fluid containing the heavy balls from the ejection ball port into the isolated interval at a flow rate which is sufficient to drive the heavy ball sealers upward from the ball ejection port to the at least one perforation.

13. The method according to claim 12, wherein the number of heavy ball sealers ejected from the ball ejection port is predetermined according to the number of perforations in the casing.

14. The method of introducing treatment fluid containing buoyant ball sealers from a ball ejection port of a production string into an oil well having a casing, the production string having means attached thereto for isolating an interval of the oil well, the casing having at least one perforation, the method comprising the steps of:

positioning the production string into the oil well so that the at least on perforation is contained within the isolated interval of the oil well and so that the ejection port is disposed above the at least one perforation;

introducing the treatment fluid containing the buoyant balls from the ejection ball port into the isolated interval at a flow rate which is sufficient to drive the buoyant ball sealers downward from the ball ejection port to the at least one perforation.

* * * * *